US011910845B2

(12) United States Patent
Cuervo et al.

(10) Patent No.: US 11,910,845 B2
(45) Date of Patent: Feb. 27, 2024

(54) SYSTEMS AND METHODS FOR A BRA FOR USE WITH LIMITED MOBILITY

(71) Applicant: SpringRose, Inc., Key Biscayne, FL (US)

(72) Inventors: Nicole Sofia Cuervo, Key Biscayne, FL (US); Iva Hammitt-Kess, Blaine, MN (US)

(73) Assignee: SPRINGROSE, INC., Evanston, IL (US)

( * ) Notice: Subject to any disclaimer, the term of this patent is extended or adjusted under 35 U.S.C. 154(b) by 72 days.

(21) Appl. No.: 17/587,457

(22) Filed: Jan. 28, 2022

(65) Prior Publication Data

US 2023/0240383 A1 Aug. 3, 2023

(51) Int. Cl.
*A41C 3/02* (2006.01)
*A41C 3/00* (2006.01)

(52) U.S. Cl.
CPC ..... *A41C 3/02* (2013.01); *A41C 3/0028* (2013.01); *A41C 3/0057* (2013.01)

(58) Field of Classification Search
CPC ..... A41C 3/02; A41C 3/0028; A41C 3/0057
USPC ..... 450/58
See application file for complete search history.

(56) References Cited

U.S. PATENT DOCUMENTS 2,970,597 A * 2/1961 Jack ..... A41C 3/02 450/71
3,302,649 A * 2/1967 Bruno ..... A41F 1/006 450/63
2001/0053655 A1* 12/2001 Keith ..... A41F 1/006 450/1
2010/0178847 A1* 7/2010 Buriak ..... A41C 3/0064 450/86
2020/0138122 A1* 5/2020 Stein ..... A41C 3/0021
2020/0345080 A1* 11/2020 Edmark ..... A41F 1/002

OTHER PUBLICATIONS

International Search Report and Written Opinion dated May 16, 2023 for International Patent Application No. PCT/US2023/011741 (15 pages).

* cited by examiner

*Primary Examiner* — Gloria M Hale
(74) *Attorney, Agent, or Firm* — QUARLES & BRADY LLP

(57) ABSTRACT

A bra for securing or supporting breasts of a user with limited mobility can include a front portion having a first panel and a second panel. The first panel can be configured to at least partially surround a first breast and the second panel can be configured to at least partially surround a second breast. First and second lateral side portions can connect a rear portion to the front portion. A band can extend around the front portion below the first panel and the second panel. A closure system can be configured to connect the band to form a continuous circuit. The closure system can include a first lateral adjustment strap, a second lateral adjustment strap, and a slider. The slider can be dimensioned to receive each of the first and second lateral adjustment straps.

20 Claims, 7 Drawing Sheets

SYSTEMS AND METHODS FOR A BRA FOR USE WITH LIMITED MOBILITY

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of clothing. More particularly, the present disclosure relates generally to brassieres ("bras") and the functionality and accessibility of a closure system thereof.

2. Description of the Background

A variety of conditions, events, or abnormalities can limit the mobility and/or dexterity of a person. In particular, certain upper body mobility impairments can include, for example, limited dexterity, limited shoulder mobility, and restricted or non-existent use of one or both arms. Limited mobility can be caused by a variety of factors, including injury, surgery, aging, birth abnormalities, or onset of disease. As such, a variety of mobility impairments may decrease a person's ability to easily, independently, painlessly, or successfully put on certain articles of clothing, including conventional bras. For example, conventional bras often require a certain closure at a back portion of a bra, coupled with often cumbersome movement and rotation of shoulders to extend arms through shoulder straps of the bra. Additionally, band adjustment in bras is often limited to specific increments of adjustment, typically provided in the back closure, which can be difficult to access or adjust while the bra is in use. Other conventional bras can include a front closure that often requires certain finger dexterity and closure manipulation that can include twisting, pivoting, or snapping, for example, that may be difficult to secure single-handedly or with limited mobility or dexterity.

SUMMARY

An article of clothing, and in particular, a bra, as described herein, may have various configurations. The bra may have a closure system that includes an adjustable front closure system. The adjustable front closure system can include first and second lateral adjustment straps.

In some embodiments, the present disclosure provides a bra for securing or supporting breasts of a user with limited mobility. The bra can include a front portion having a first panel and a second panel. The first panel can be configured to at least partially surround a first breast and the second panel can be configured to at least partially surround a second breast. First and second lateral side portions can connect a rear portion to the front portion. A band can extend around the front portion below the first panel and the second panel. A closure system can be configured to connect the band to form a continuous circuit. The closure system can include a first lateral adjustment strap, a second lateral adjustment strap, and a slider. The slider can be dimensioned to receive each of the first and second lateral adjustment straps.

In some embodiments, the present disclosure provides an adjustable closure system for a bra. The bra can have a front portion and a rear portion connected via first and second shoulder straps. The closure system can include an option rear closure system and a front closure system. The rear closure system can be configured to connect a band of the bra to form a continuous circuit around a posterior portion of a torso. The front closure system can be configured to connect the band of the bra to form a continuous circuit around an anterior portion of the torso. The front closure can include a slider and at least one lateral adjustment strap extending from a medial end of the front portion of the bra. The at least one lateral adjustment strap can be dimensioned to extend through the slider in a lateral direction away from the medial end of the front portion and be secured to the band.

In some embodiments, the present disclosure provides a method of adjusting a bra. The method can include inserting a first arm through a first opening provided by a first shoulder strap, inserting a second arm through a second opening provided by a second shoulder strap, pulling on a first lateral strap in a first lateral direction to tighten a band of the bra, pulling on a second lateral strap in a second lateral direction opposite the first lateral direction, to tighten the band of the bra, securing the first lateral strap relative to the band, and securing the second lateral strap relative to the band.

DETAILED DESCRIPTION OF THE DRAWINGS

Figure 1:
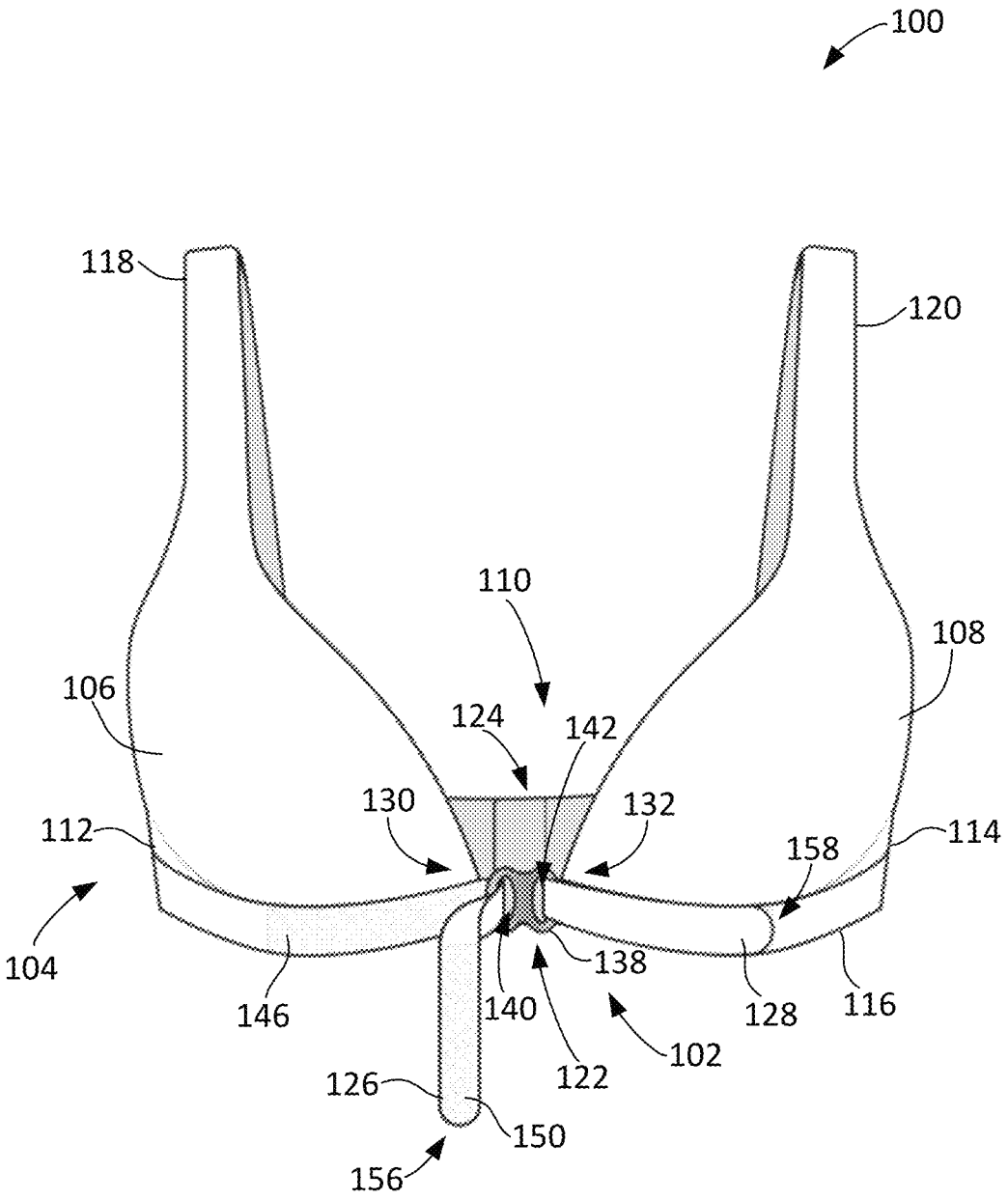
FIG. 1 is a front view of a mobility bra according to an embodiment of the present disclosure.

The following discussion and accompanying figures disclose various embodiments or configurations of a bra and a closure system. Although embodiments of a bra or closure system are disclosed with reference to a wireless bra, concepts associated with embodiments of the bra or closure system may be applied to a wide range of undergarments and closure systems, including underwire bras, bralettes, strapless bras, nursing bras, and razorback bras, for example.

Concepts of the bra or closure system may also be applied to other articles of clothing including corrective or supportive garments that may benefit from an adjustable or limited mobility closure system. Accordingly, concepts described herein may be utilized in a variety of consumer products.

The term "about," as used herein, refers to variation in the numerical quantity that may occur, for example, through typical measuring and manufacturing procedures used for articles of clothing or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

As briefly described above, a variety of conditions, events, or abnormalities can limit the mobility of a person. In particular, certain upper body mobility impairments can include, for example, limited dexterity, limited shoulder mobility, and restricted or non-existent use of one or both arms. Limited mobility can be caused by a variety of factors, including stroke paralysis, nerve damage, rotator cuff injuries and other injuries, surgery, aging, birth abnormalities, arthritis, fibromyalgia, scleroderma, and other diseases. As such, a variety of mobility impairments may decrease a person's ability to easily, independently, painlessly, or successfully put on certain articles of clothing including conventional bras.

For example, conventional bras require skilled closure at a back portion of a bra coupled with often cumbersome movement and rotation of shoulders to extend arms through shoulder straps of the bra. Additionally, band adjustment in bras is often limited to specific increments of adjustment, typically provided in the back closure, which can be difficult to access or adjust while the bra is in use. Other conventional bras can include a front closure that often requires certain finger dexterity and closure manipulation that can include twisting, pivoting, or snapping, for example, that may be difficult to secure single-handedly or with limited mobility or dexterity.

Thus, embodiments of the present disclosure address these and other drawbacks of conventional bras. For example, embodiments of the present disclosure provide a mobility bra that can be used when a user has limited or decreased mobility in their upper body. Embodiments of the mobility bra described herein can provide a front closure that is accessible while wearing the bra and lateral adjustment straps that can be infinitely (e.g., continuously) adjusted to tighten or loosen the band of the bra. Further, embodiments of the present disclosure provide a bra that can be used, adjusted, and removed via one-handed operation. Contrastingly, traditional bras often require two hands to close the main closure, such as one hand to hold an eye portion of a hook and eye clasp and another hand to secure an eye portion of the hook and eye clasp. Embodiments of the invention can advantageously provide a one-handed closure method that can include threading one or more lateral adjustment straps through a fixed slider positioned at an anterior position of the body.

FIG. 1 illustrates an exemplary embodiment of a mobility bra 100 having a closure system 102. The mobility bra 100 can include a front portion 104 having first and second panels 106, 108. Each of the first and second panels 106, 108 can be generally triangularly shaped and can define cup portions of the mobility bra 100. In general, the cup portions of the mobility bra 100 can be used to surround and/or support breasts of an end user. While the first panel 106 and the second panel 108 generally define geometries similar to that of traditional bras, other geometries and constructions are possible, including geometries that may provide more or less coverage or support to the end user.

Figure 2:
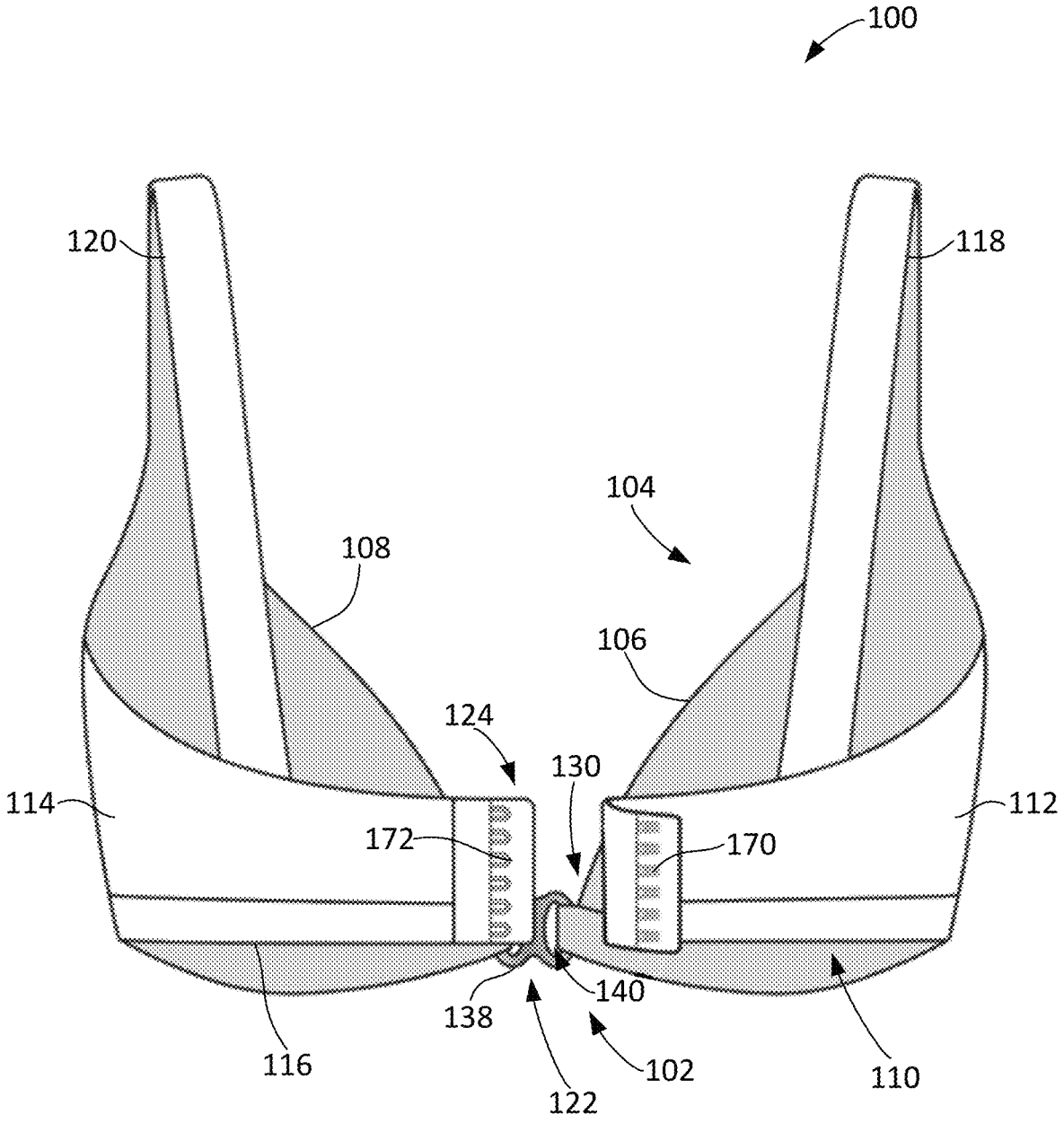
FIG. 2 is a rear view of the mobility bra of FIG. 1.

Referring to FIG. 2, the mobility bra 100 can further include a rear portion 110 opposite the front portion 104. The rear portion 110 can be connected to the front portion 104 via a first lateral side portion 112 and a second lateral side portion 114. Each of the first and second lateral side portions 112, 114 can at least partially define a band 116 of the mobility bra 100. In general, the band 116 is configured to surround the rib cage of a wearer below the breasts and can define at least one dimension used by an end user to determine fit of the mobility bra 100. In a secured configuration of the mobility bra 100, the band 116 can form a continuous circuit around the torso of the user and extend generally horizontally below their breasts. Additionally, in some embodiments, the band 116 or portions of the band 116 can include an elastic material to further provide adjustment and comfort of the mobility bra 100.

The mobility bra 100 can further include a first shoulder strap 118 and a second shoulder strap 120. Each of the first and second shoulder straps 118, 120 also connect the front portion 104 and the rear portion 110. In particular, each of the first and second shoulder straps 118, 120 can extend from a top portion of the respective first and second panels 106, 108. In some embodiments, the first panel 106 can be integrally formed with the first shoulder strap 118 and the second panel 108 can be integrally formed with the second shoulder strap 120. However, in other embodiments, the first and second panels 106, 108 may be sewed, adhered, fastened, or otherwise affixed to the respective first and second shoulder straps 118, 120. In some embodiments, the shoulder straps 118, 120 can include adjustable straps so that the straps can be lengthened or shortened on an individual user basis.

With reference to FIG. 1, the closure system 102 of the mobility bra 100 can include a front closure system 122 and a rear closure system 124. The front closure system 122 may be generally positioned near an anterior portion of a torso of a user. The front closure system 122 can include a first lateral adjustment strap 126 and a second lateral adjustment strap 128. The first lateral adjustment strap 126 can extend from a medial part 130 of the first panel 106 and the second lateral adjustment strap 128 can extend from a medial part 132 of the second panel 108.

In some embodiments, a length of the first lateral adjustment strap 126, as measured between the medial part 130 and a distal end 156, may be between approximately 10% and 40% of the circumference of the band 116, or, in some embodiments, may be between approximately 20% and 30% of the circumference of the band 116. A length of the second lateral adjustment strap 128, as measured between the medial part 132 and a distal end 158, may have a similar length to the first lateral adjustment strap 126. For example, if the circumference of the band 116, and thus the circumference of a user's torso, is approximately 40 inches, then the length of the first and second lateral adjustment straps 126, 128 may be between approximately 4 inches and 16 inches (inclusive), or, in some embodiments, may be between approximately 8 inches and 12 inches (inclusive). In general, the length of each of the first and second lateral adjustment straps 126, 128 provides sufficient contact between the straps 126, 128 and the band 116 to retain the straps 126, 128 in a secured orientation while not requiring overextension of a user's arm to secure the straps 126, 128 adjacent to their lateral sides.

In some embodiments, the first lateral adjustment strap 126 can be integrally formed with the first panel 106 and the second lateral adjustment strap 128 can be integrally formed with the second panel 108. However, in other embodiments, the first and second lateral adjustment strap 126, 128 may be sewed, adhered, fastened, or otherwise affixed to the respective first and second panels 106, 108. In general, the mobility bra 100 can include first and second halves that are at least separatable at the front closure system 122. In some embodiments, the halves may be fully separatable at the front closure system 122 and the rear closure system 124. In some embodiments, this may improve manufacturing processes of the mobility bra 100 such that two symmetric halves can be manufactured independently from a similar template.

Still referring to FIG. 1, the front closure system 122 can further include a slider 138. In the illustrated embodiment, the slider includes a first opening 140 and a second opening 142. The first opening 140 is dimensioned to receive the first lateral adjustment strap 126 and the second opening 142 is dimensioned to receive the second lateral adjustment strap 128. In general, the medial part 130 of the first panel 106 and the medial part 132 of the second panel 108 may be connected when the first lateral strap 126 is threaded through the slider 138 and the second lateral strap 128 is threaded through the slider 138.

In other embodiments, the slider 138 can include more or fewer openings than illustrated in FIG. 1. For example, a slider can include a single opening configured to receive both of the first and second lateral adjustment straps 126, 128. In other embodiments, the slider 138 may be removable or adjustable such that variety of sliders or slider sizes can be used in the front closure system 122. The variability of the slider 138 can provide adjustable or variable sizes of the mobility bra 100 to adapt to a given user.

In the illustrated embodiment, each of the first lateral adjustment strap 126 and the second lateral adjustment strap 128 are disposed adjacent to, and can at least partially form, the band 116. For example, when one of the first and second lateral adjustment straps 126, 128 are in a secured position, the strap 126, 128 can overlap a portion of the band 116 (see, for example, the second lateral adjustment strap 128 in FIG. 1). Each of the first and second lateral adjustment straps 126, 128 can define a strap width that is substantially equal to or less than the width of the band 116. As will be described in further detail below, the first and second lateral adjustment straps 126, 128 can generally provide supplemental support to the user at the band 116 when the straps 126, 128 are in a secured position.

As illustrated in FIG. 1, the front closure system 102 can further include a hook and loop fastener (e.g., Velcro®) to secure the first and second lateral adjustment straps 126, 128. In particular, a portion of the band 116 adjacent to the first panel 106 and a portion of the band 116 adjacent to the second panel 108 can include a first loop area 146 and a second loop area (not shown), respectively. In general, the second loop area may be substantially similar to the first loop area 146 and symmetrically disposed on the band 116 about the slider 138. The first and second loop areas 146 are configured to be secured to a respective first and second hook area 150 (only the first hook area 150 is shown) of the respective first and second lateral adjustment straps 126, 128.

In general, the loop portion of a hook and loop fastener can be less texturally rough, scratchy, or otherwise irritating compared to the hook portion of the hook and loop fastener. In this regard, in some embodiments, the first and second loop areas 146 may be disposed on or otherwise secured to the band 116 of the mobility bra 100 adjacent to (i.e., below) the respective first and second panels 106, 108. Affixing the first and second loop areas 146 to the band 116 can generally reduce unwanted scratching or irritation to the end user, particularly to a user's arm, torso, or breast. Additionally, the advantageous position of the first and second loop areas 146 on the band 116 can limit or reduce unwanted snagging between the front closure system 122 and other clothes or garments that may be otherwise associated with a hook portion of a hook and loop fastener.

In other embodiments, the first and second hook areas 150 may be disposed on or otherwise secured to the band 116 of the mobility bra 100 adjacent to the respective first and second panels 106, 108. Correspondingly, the first and second loop 146 areas may be disposed on or otherwise secured to the respective first and second lateral adjustment straps 128, 130. Advantageously, this can reduce scratching if a user overextends or misaligns the lateral adjustment straps 128, 130 with the band 116 and the loop areas 146 come in contact with skin or other surfaces (e.g., clothing) that may be otherwise scratched or snagged by a hook portion of a hook and loop fastener.

Correspondingly, the first and second hook areas 150 of the front closure system 122 can be disposed at distal ends 156, 158 of a respective rear-facing side of the respective first and second lateral adjustment straps 126, 128. In use, the front closure system 122 may be in a secured position when each of the first and second lateral adjustment straps 126, 128 are threaded through the slider 138 and the respective rear-facing sides of the first and second lateral adjustment straps 126, 128 are secured to the band 116. The lateral adjustment strap 126, 128 can be secured to the band 116 via the first hook area 150 secured to the first loop area 146 and the second hook area secured to the second loop area. In some embodiments, the front closure system 122 may be incrementally or continuously adjustable such that the first and second lateral adjustment straps 126, 128 can be pulled at various tensions through the slider 138 to tighten or loosen the band 116.

With continued reference to FIG. 1, each of the first and second distal ends 156, 158 of the respective first and second lateral adjustment straps 126, 128 can include a particular end geometry. For example, as shown in FIG. 1, the end geometry of the first and second distal ends 156, 158 of the respective first and second lateral adjustment straps 126, 128 includes a rounded edge. However, in other embodiments, other geometries are possible, as will be discussed in further detail with respect to FIGS. 4 and 5. In general, the end geometry of the first and second distal ends 156, 158 of the respective first and second lateral adjustment straps 126, 128 can enhance the ability of the adjustment straps 126, 128 to be inserted and threaded through the slider 138. For example, the rounded edge of the first and second distal ends 156, 158 provides a tapered or narrowed portion of the straps 126, 128 to guide the distal ends 156, 158 through the slider 138, which can, for example, promote one-handed use.

Referring again to FIG. 2, the closure system 102 of the mobility bra 100 can also include the rear closure system 124. The rear closure system 124 may be generally positioned near a posterior portion of a torso of a user. The rear closure system 124 can be formed at distal ends of the first and second lateral side portions 112, 114 adjacent to the band 116. In particular, the rear closure system 124 can include hook and eye fasteners. For example, one or more columns of hooks can be disposed on the distal end of the first lateral side portion 112 and one or more columns of corresponding eyes 172 can be disposed on the distal end of the second lateral side portion 114. The rear closure 124 may be generally adjustable by aligning and securing a column of hooks 170 with one of the one or more columns of eyes 172 to increase or decrease tension in the band 116.

In some embodiments, the closure system 102, including the front closure system 122 and the rear closure system 124, can include a variety of closure mechanism or techniques, such as one or more of hook and loop fasteners, hook and eye fasteners, adhesion fasteners, snap fasteners, tie fasteners, and magnetic fasteners, for example. In other embodiments, the closure system 102 may only include a single closure, such as the front closure system 122. In this regard, the first lateral side portion 112 and the second lateral side portion 114 may be integrally formed or otherwise affixed at a rear portion of the mobility bra 100 near a posterior portion of a torso of a user (e.g., similar to the geometry or construction of a racerback bra). In other embodiments, a closure system similar to the front closure system 122 may be provided at a rear side of a mobility bra so that, in use, the closure system similar to the front closure system 122 is positioned adjacent to a posterior portion of a torso of a user.

In general, the closure system 102, such as the combination of the front closure system 122 and the rear closure system 124, can provide a wide variety of adjustability of the mobility bra 100. For example, each of the front closure system 122 and the rear closure system 124 can independently add or decrease tension provided at the band 116. Additionally, each of the first lateral adjustment strap 126 and the second lateral adjustment strap 128 can provide independent adjustment at (or near) the band 116. The independent adjustment of the first and second lateral adjustment straps 126, 128 can be useful, for example, when different tension or support is desired at each breast.

Figure 3:
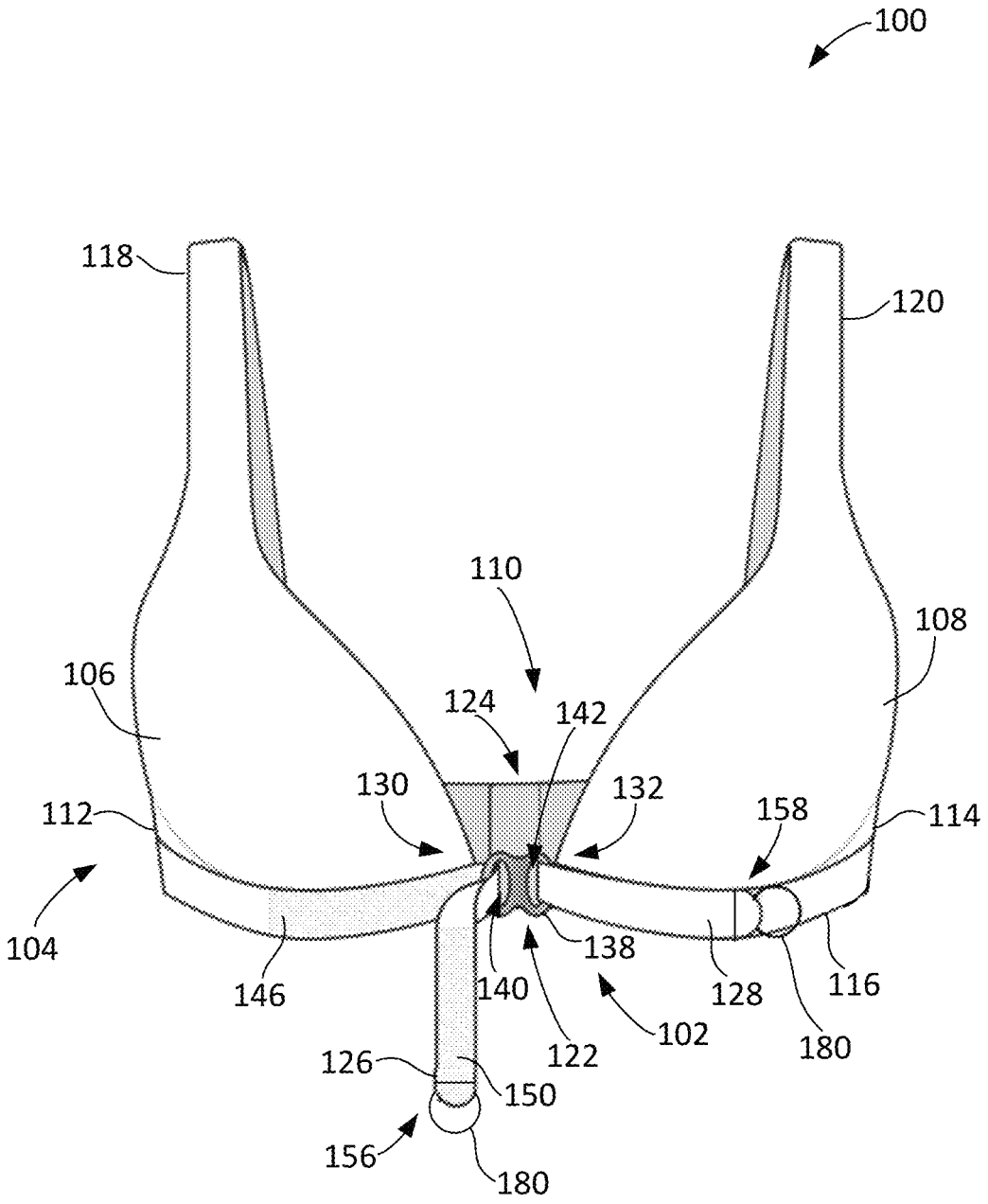
FIG. 3 is a front view of the mobility bra of FIG. 1 including a pull element according to an embodiment of the present disclosure.

Referring now to FIG. 3, the first and second lateral adjustment straps 126, 128 of the mobility bra 100 can include a pull element. In the illustrated embodiment, the pull element is configured as a ring 180. First and second rings 180 can be secured to the first and second distal ends 156, 158 of the first and second lateral adjustment straps 126, 128. While the pull elements of FIG. 3 are generally configured as rings 180, other pull elements are possible. For example, pull elements for a mobility bra such as the mobility bra 100 can include rings, D-rings, washers, loops, or other grippable elements. It may be generally useful to include a pull element having a recess or through hole through which a user can extend a digit (e.g., a finger) to pull or otherwise provide tension to lateral adjustment straps.

In addition to providing a grip point, the rings 180 or other pull elements can also provide a stop for the first and second lateral adjustment straps 126, 128. In particular, the rings 180 or other pull elements can be dimensioned so that they cannot extend or be threaded (easily or forcefully) through the slider 138. For example, in some embodiments, once the ring 180 is secured to the first distal end 156 of the first lateral adjustment strap 126, the distal end 156 may not be able to pass through the first opening 140 of the slider 138. In general, this may allow for the mobility bra 100 to be moved between an unsecured and secured configuration while maintaining a connection of the first panel 106 with the second panel 108 at the front portion 104. In use, maintaining a connection between the first panel 106 and the second panel 108 can aid a user with limited mobility (such as a single working arm, for example) and/or limited dexterity (such as limited grip ability or strength) by reducing the number of movements and connections required to secure the mobility bra 100 in a comfortable and supportive position on the user.

Figure 4:
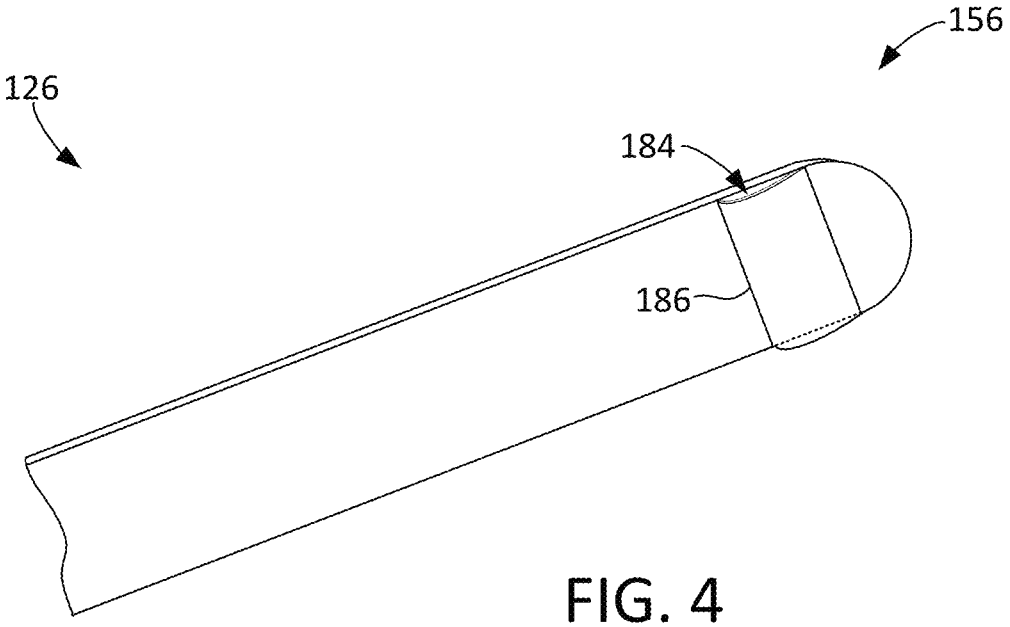
FIG. 4 is a detailed view of an adjustment strap of the mobility bra of FIG. 3.

With reference to FIG. 4, the ring 180, or other pull element, can be secured to a distal end of a lateral adjustment strap via an opening in the lateral adjustment strap. For example, FIG. 4 illustrates the distal end 156 of the first lateral adjustment strap 126. While only the first lateral adjustment strap 126 is shown, it should be understood that the following description can alternatively or additionally be applied to the distal end 158 of the second lateral adjustment strap 126. As shown, the distal end 156 includes an opening 184 adjacent to the rounded edge. The opening 184 can be formed via an integral void in the distal end 156 of the first lateral adjustment strap 126. However, in other embodiments, the opening 184 can be formed by affixing a pocket 186 to an interior or exterior side of the first lateral adjustment strap 126.

Still, in other embodiments, the opening 184 can be formed by folding back a portion of the lateral adjustment strap 126 near the distal end 156 and affixing (e.g., sewing or gluing) the distal end 156 to the lateral adjustment strap 126 to form a loop. The loop can form the opening 184 to secure a pull element, such as the ring 180. However, in other embodiments, the loop can provide an integrally formed pull element near the distal end 156 of the adjustment strap 126.

In general, the pull element, such as the ring 180, may be an optional feature of the mobility bra 100. In this regard, the opening 184 formed in the distal end 156 of the lateral adjustment strap 126 may be optionally used or unused, depending on user-specific needs. In embodiments where the ring 180 is dimensioned to resist movement through the slider 138, the ring 180 may be installed on the lateral adjustment strap 126 after the distal end 156 of the lateral adjustment strap 126 has been successfully threaded through and received by the slider 138. Thus, the ring 180 or other pull element may be equipped with an opening mechanism, such as, for example an opening mechanism similar to a key ring, a hinge and latch closure, or a deflectable (i.e., bendable) structure that allows selective opening and closing of the pull element to be secured to the distal end 156 of the lateral adjustment strap 126.

Figure 5:
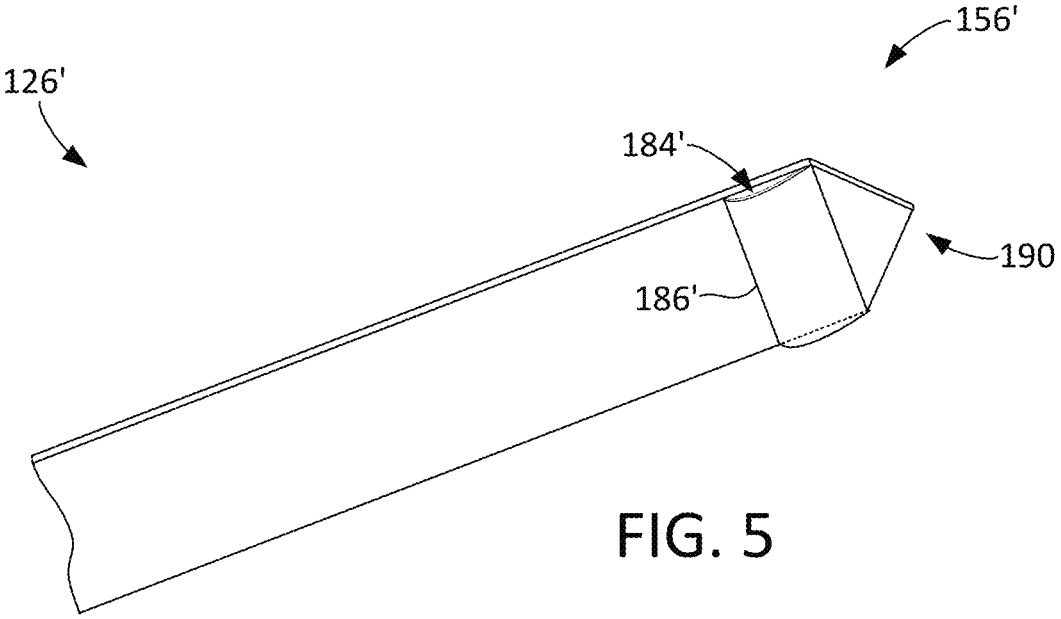
FIG. 5 is a detailed view of another example of an adjustment strap according to an embodiment of the present disclosure.

FIG. 5 illustrates another example of a distal end 156' of a lateral adjustment strap 126' according to an embodiment of the present disclosure. The distal end 156' of the lateral adjustment strap 126' may be substantially similar to the distal end 156 of the lateral adjustment strap 126 and may be used with or included in the mobility bra 100. Like the lateral adjustment strap 126, the distal end 156' of the lateral adjustment strap can include an opening 184' formed by a pocket 186'. The distal end 156' can further include an end geometry configured as a pointed edge 190. Similar to the rounded edge of the distal end 156 (see, e.g., FIG. 4), the pointed edge 190 can enhance the ability of the lateral adjustment strap 126 to be inserted and threaded through a slider, such as the slider 138. For example, the pointed edge 190 can provide a narrowed portion to guide the distal end 156' through a slider, which can, for example, promote one-handed use. In some embodiments, the distal ends 156, 156' can provide a relatively rigid geometry to facilitate threading the lateral adjustment strap through the slider.

As described above, embodiments described herein can provide a bra, such as the mobility bra 100, that can be worn, secured, and adjusted by a variety of users, including those with limited mobility. Such limited mobility can include, for example, limited shoulder mobility (e.g., limited movement and rotation), limited or non-existent arm mobility, and limited or non-existent digit mobility. Embodiments of the system described above can provide a mobility bra with increased accessibility compared to that of conventional bras. In this regard, embodiments of the invention also provide methods of wearing, adjusting, securing, or otherwise using a bra, similar to the mobility bra 100 described above.

Figure 6:
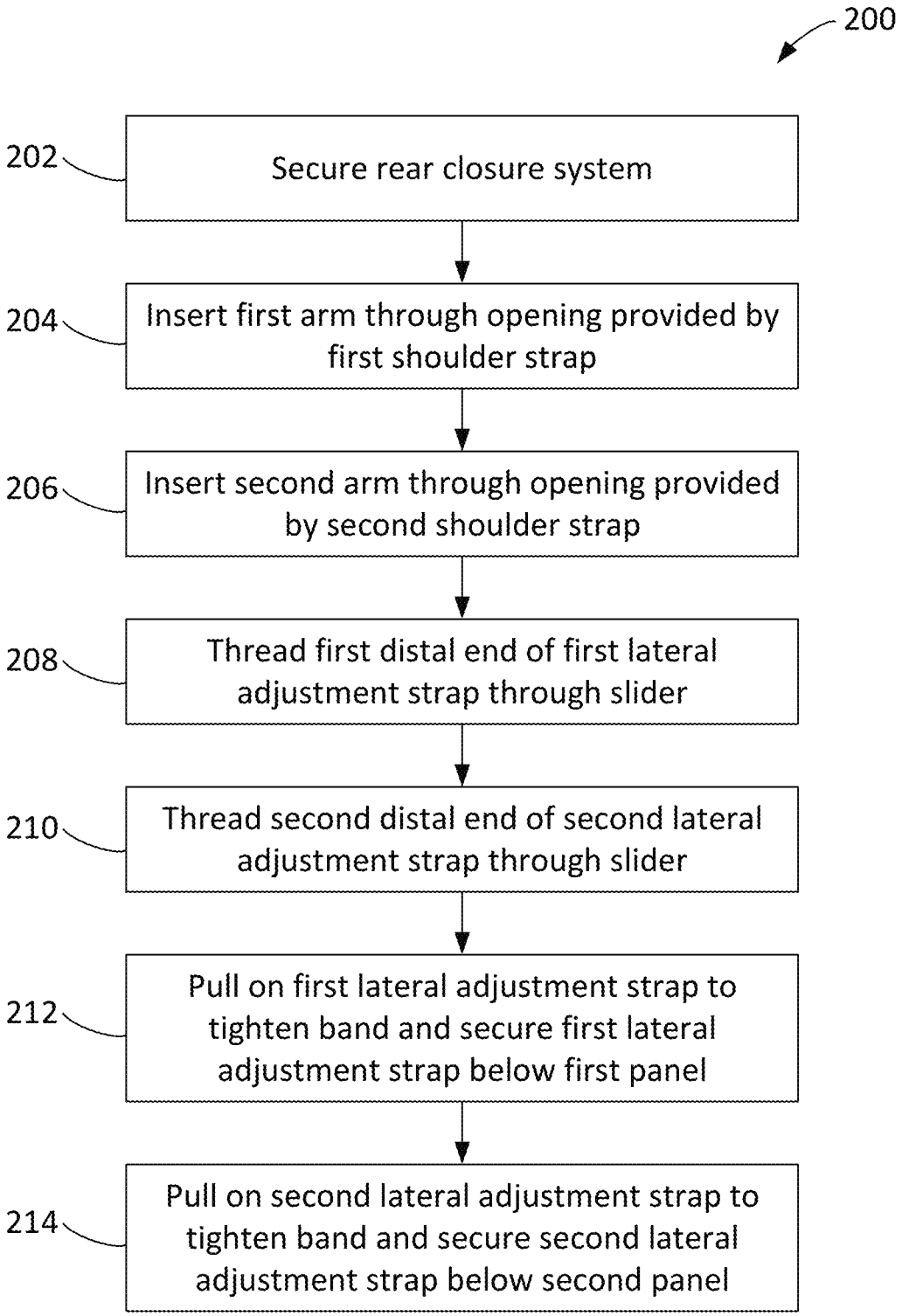
FIG. 6 is a flowchart illustrating a method of using the mobility bra of FIG. 1 according to one embodiment of the present disclosure.
Figure 7:
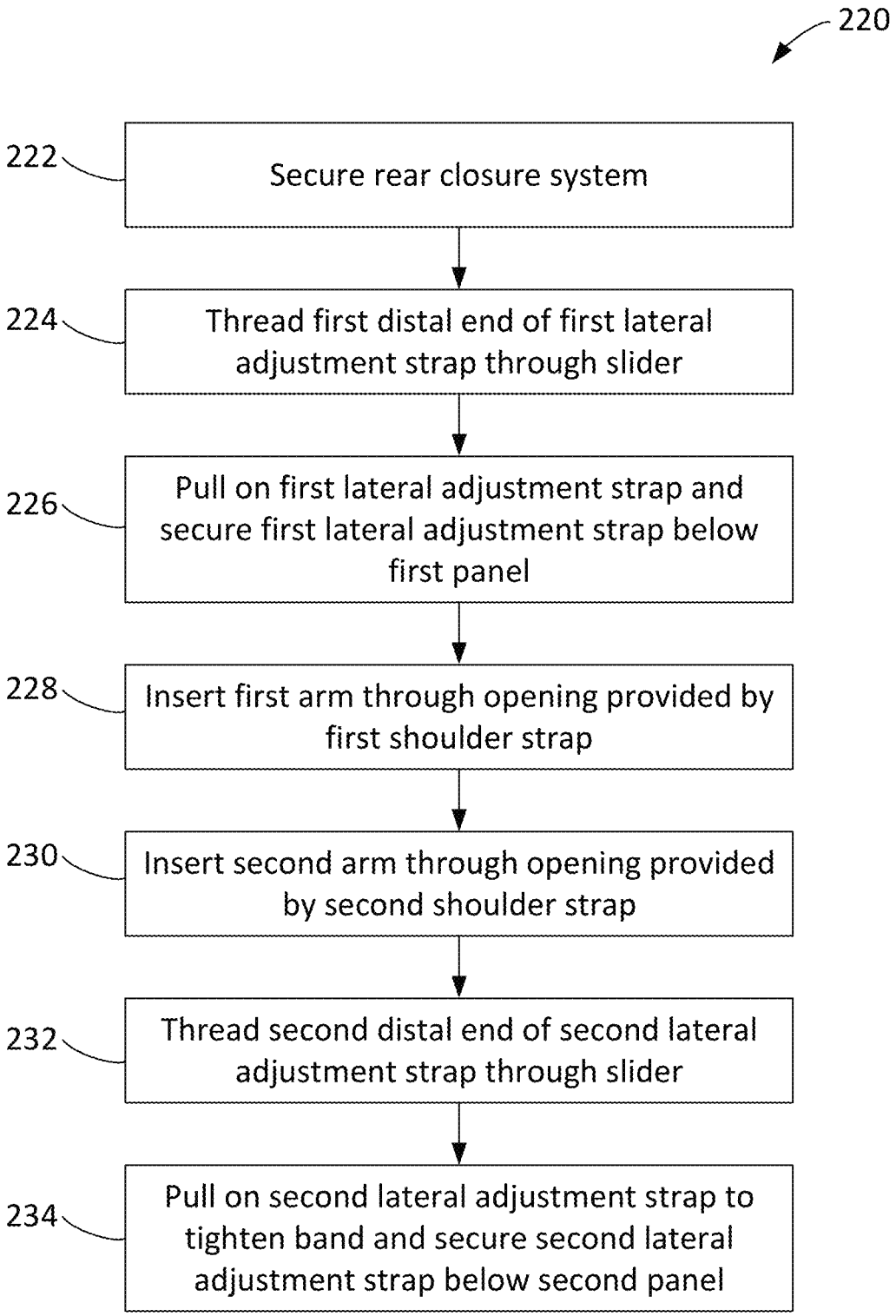
FIG. 7 is a flowchart illustrating a method of using the mobility bra of FIG. 1 according to another embodiment of the present disclosure.
Figure 8:
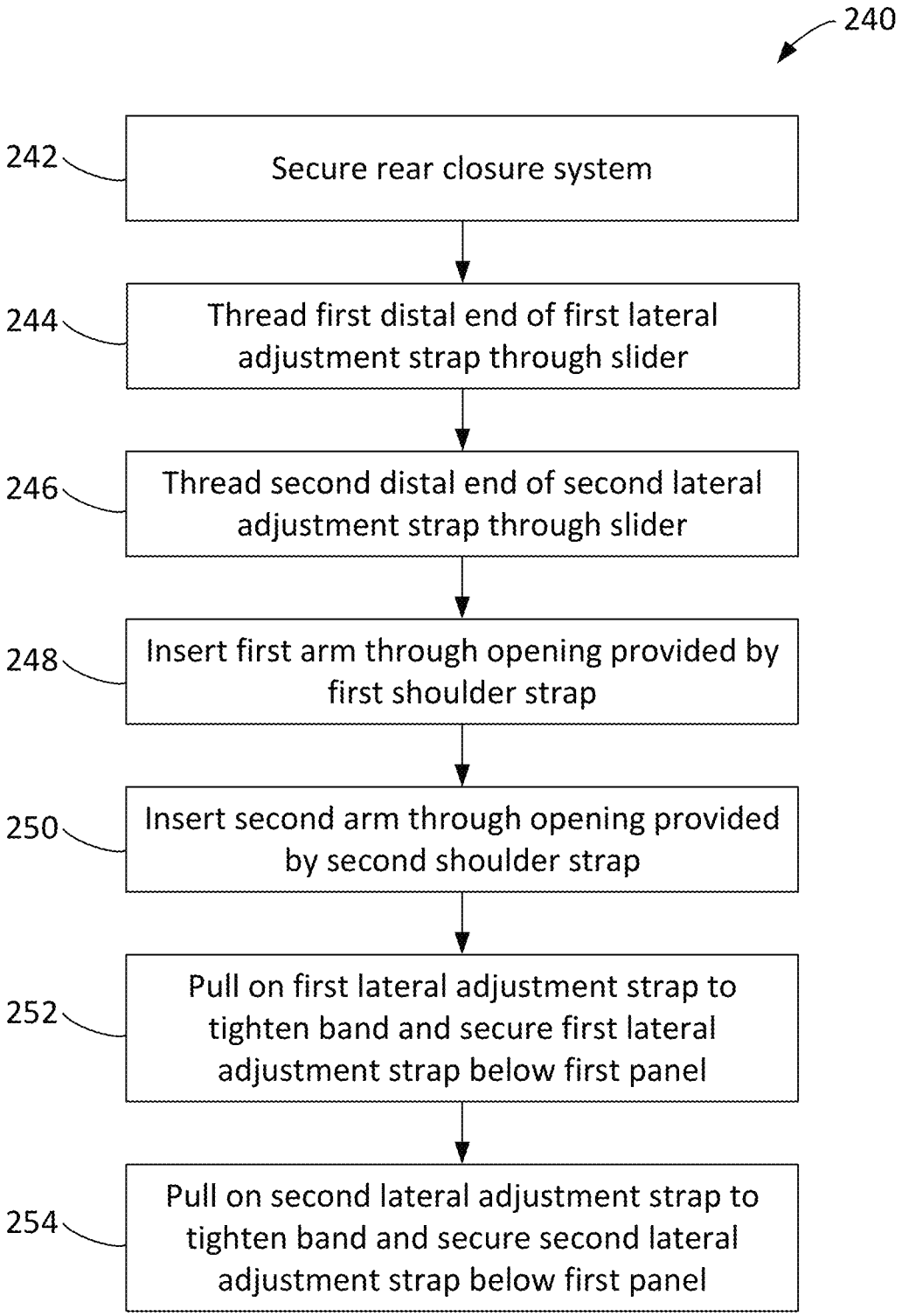
FIG. 8 is a flowchart illustrating a method of using the mobility bra of FIG. 1 according to another embodiment of the present disclosure.

FIGS. 6-8 illustrate various methods of using (i.e., wearing, securing, and adjusting) a mobility bra, such as the bra 100, according to embodiments of the present disclosure. In general, elements of the methods illustrated in FIGS. 6-8 can include elements of the mobility bra 100 or other mobility bras. Thus, elements of the methods illustrated in FIGS. 6-8 and described below will be in reference to general elements of a mobility bra, such as a front closure system, a rear closure system, a first lateral adjustment strap, a second lateral adjustment strap, a slider, etc. However, it should be understood that elements of the methods illustrated in FIGS. 6-8 can correspond to elements of the mobility bra 100, such as the front closure system 122, the rear closure system 124, the first lateral adjustment strap 126, the second lateral adjustment strap 128, the slider 138, etc.

Referring now to FIG. 6, a method 200 of using a mobility bra is shown. The method 200 includes, at step 202, securing a rear closure system of the mobility bra. In some embodiments, the rear closure system can be closed while the bra is not adjacent to a torso of a user, while the bra is adjacent to the torso of the user and the rear closure is temporarily disposed at an anterior position (i.e., near the front) of the torso, or while the bra is adjacent to the torso of the user and the rear closure is disposed at a posterior (i.e., near the back) of the torso. At steps 204 and 206, the user may insert their first and second arms through respective openings provided by the first and second shoulder straps. Steps 202 through 206 can occur in any order or in parallel.

In general, step 202 may be similar to the initial step taken to put on a conventional bra with a rear closure. In general, the rear closure system can be closed while the bra is not adjacent to a torso of user. In some embodiments, step 202 may be omitted if the back closure is permanently closed or otherwise nonexistent, similar to a conventional front closure bra. At steps 204 and 206, the user can insert their arms through the first and second shoulder straps in a movement similar to putting on a vest. In other embodiments, if the front closure system is closed before the rear closure system, the rear closure system can be secured while the bra is adjacent (e.g., at least partially surrounding) the torso and the rear closures system is disposed at an anterior position. The user can then rotate the bra to position the rear closure near the posterior portion of the torso before inserting their arms through the shoulder straps.

Steps 208 and 210 of method 200 include threading (e.g., inserting) first and second distal ends of respective first and second lateral adjustment straps through a slider. The slider may be generally positioned adjacent to an anterior portion of the torso. Steps 212 and 214 include pulling on the respective lateral adjustment straps to tighten the band of the bra and securing the lateral adjustment straps below a front portion of first and second panels of the bra. In general, steps 208 and 210 can be done in any order or in parallel. Additionally, steps 212 and 214 can be done in any order or in parallel. Further, step 212 may directly follow step 208 and step 214 may directly follow step 210 so that each lateral adjustment strap is threaded through the slider and secured under a respective front panel of the bra in fluid or consecutive motions.

In use, at steps 212 and 214, the mobility bra may be adjusted or loosened by pulling on the lateral adjustment straps. In particular, a user may pull one (or both) of the lateral adjustment straps laterally away from their body in a direction, for example, parallel or near parallel to the ground while the user may be in a generally upright (e.g., standing or sitting) position to tighten the band. For example, a user may pull a lateral adjustment strap that is disposed on their right side (e.g., positioned under their right breast) laterally to the right to tighten the band. Correspondingly, the user may pull a lateral adjustment strap that is disposed on their left side (e.g., positioned under their left breast) laterally to the left to tighten the band.

As briefly described above, the bra used in the method illustrated in FIG. 6 can include embodiments of the bra described herein, such as the mobility bra 100 illustrated in FIG. 3 equipped with pull elements. The pull elements can include the rings 180 or other pull features such as O-shaped rings, D-shaped rings, pull tabs, or pockets integrally formed with a lateral adjustment strap, for example. In this regard, at steps 212 and 214 of the method 200, pulling on the first and second lateral adjustment straps to tighten the band and secure the first and second lateral adjustment straps below the respective first and second panels can include pulling via a pull element (e.g., the ring 180). In some embodiments, the pull element may be installed on one or both of the lateral adjustment straps after the lateral adjustment strap has been threaded through the slider.

Though not depicted in FIG. 6, it should be understood that the user can correspondingly loosen the band via the first and second lateral adjustment straps by generally urging the lateral adjustment straps proximally (i.e., toward the center of their body) or by pulling on the first and/or second panels of the front portion of the bra to withdraw the lateral adjustment straps through the slider.

FIG. 7 illustrates a method 220 of using a mobility bra. The method 220 can include, at step 222, securing a rear closure system of the mobility bra. The rear closure system may be secured while the bra is not adjacent to a torso of a user. At step 224, the user can thread a first distal end of a first lateral adjustment strap through a slider. Again, step 224 may occur when the bra is not adjacent to the torso of the user. Additionally, steps 222 and 224 can take place in any order or in parallel. At step 226, once the distal end of the first lateral adjustment strap has been threaded through the slider, the user can secure the first lateral adjustment strap below a first panel (i.e., a cup) of the bra. At this stage, the rear closure system has been secured; however, the front closure system remains open and only a single lateral adjustment strap has been threaded through the slider.

At step 228, the user can use the bra to at least partially surround their torso by, for example, inserting first and second arms through respective first and second shoulder straps (e.g., a motion similar to putting on a vest). At steps 232 and 234, the user can then thread a second distal end of a second lateral adjustment strap through the slider and secure the second lateral adjustment strap below a second front panel (i.e., a cup). After step 234, method 220 may be complete. Otherwise, if further adjustment (e.g., support or tension) is required, the user can unsecure one or both of the lateral adjustment straps, adjust the band as necessary, and resecure the lateral adjustment straps.

As similarly described above with respect to FIG. 6, the bra used in the method illustrated in FIG. 7 can include embodiments of the bra described herein, such as the mobility bra 100 illustrated in FIG. 3 equipped with pull elements (e.g., the rings 180). In this regard, at steps 226 and 234 of the method 220, pulling on the first and second lateral adjustment straps to tighten the band and secure the first and second lateral adjustment straps below the respective first and second panels can include pulling via a pull element (e.g., the ring 180).

FIG. 8 illustrates a method 240 of using a mobility bra. The method 240 can include, at step 242, securing a rear closure system of the mobility bra. The rear closure system may be secured while the bra is not adjacent to a torso of a user. At steps 244 and 246, the user can thread first and second distal ends of respective first and second lateral adjustment straps through a slider. In some embodiments, once the user has threaded the first and second lateral adjustment straps through the slider, they may install first and second pull elements to the distal ends of the respective first and second lateral adjustment straps. The pull elements can provide an opening and grip point that allow the user to easily grasp and pull on the lateral adjustment straps while preventing the lateral adjustment straps from withdrawing through the slider. For example, the pull elements can be configured as a removable ring (e.g., ring 180) that has a diameter (or other dimension) greater than the opening in the slider which prevents the distal ends from passing through the slider, particularly after the first and second lateral adjustment straps have been threaded through the slider.

After steps 244 and 246, the bra can form a continuous circuit (i.e., torso opening) at least partially formed by the band and the first and second lateral adjustment straps. The user can use the bra to surround their torso by, for example, pulling the bra over their head or stepping into the torso opening of the bra feet first. The torso opening can be increased or decreased based on the proximity of each of the distal ends of the lateral adjustment straps to the slider. For example, the torso opening may be at a maximum when the distal ends of the lateral adjustment straps are proximate to the slider and stopped from passing through the slider by a removable ring or other pull element secured at the distal ends.

At steps 248 and 250, once the bra is positioned around the torso, the user can insert their arms through the openings provided by the first and second shoulder straps. Once each arm is extended through the opening provided by each shoulder strap, or, more generally, once each shoulder strap is positioned on each respective shoulder, the user can tighten the first and second lateral adjustment straps at steps 252 and 254. As similarly described above with respect to FIGS. 6 and 7, steps 252 and 254 of pulling on the first and second lateral adjustment straps to tighten the band and secure the first and second lateral adjustment straps below the respective first and second panels can include pulling via the pull element (e.g., the ring 180).

In general, the methods 200, 220, and 240 may promote one-handed operation of wearing, adjusting, and securing a mobility bra. For example, regarding method 220, if a user only has one working hand, arm, or shoulder, steps 222 through 234 can be completed using only the one working hand, arm, or shoulder. Additionally, any of the methods described herein can reduce the range of movement generally associated with putting on and adjusting a bra so that individuals with limited mobility can wear and adjust the bra, such as the mobility bra 100. Further, as described above with respect to the mobility bra 100, some embodiments of a mobility bra may not include a rear closure system and a rear portion of the bra may be permanently affixed. In this regard, the step of securing a rear closure system may be omitted. Additionally, it should be appreciated that steps of each of the methods 200, 220, and 240 can be applied, substituted, rearranged, or otherwise incorporated into each of the methods 200, 220, 240.

The present disclosure is directed to an article of clothing, and/or specific components and closure systems for an article of clothing, such as a bra and its respective closure system. The bra may comprise a fabric material, such as, for example, nylon, polyester, cotton, Spandex, silk, or other materials generally made by knitting, weaving, or forming. The closure systems described herein may comprise a variety of materials including, for example, metals and polymers, which can have varying properties or varying visual characteristics.

Any of the embodiments described herein may be modified to include any of the structures or methodologies disclosed in connection with different embodiments. Further, the present disclosure is not limited to bras of the type specifically shown. Still further, aspects of the bra and methods of using the bra according to any of the embodiments disclosed herein may be modified to work with any type of article of clothing or supportive undergarment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

The systems of a methods of a bra and closure system as described herein advantageously provide an undergarment, and more specifically, a supportive undergarment, having enhanced adjustment and securement capabilities that can be utilized by an end user having limited mobility.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

The invention claimed is:

1. A mobility bra, comprising:

a front portion having a first panel that can be separated is separable or connectable from a second panel, the first panel being configured to at least partially surround a first breast, the second panel being configured to at least partially surround a second breast;

a rear portion;

a first lateral side portion connecting the first panel of the front portion and the rear portion;

a second lateral side portion connecting the second panel of the front portion and the rear portion;

a band extending around the front portion below the first panel and the second panel; and first and second closure systems configured to connect and disconnect the band, which forms a continuous circuit when connected, the first closure system including:

a front closure system for connecting the band to form the continuous circuit at the front portion, the front closure system including:

a first lateral adjustment strap;

a second lateral adjustment strap; and a slider.

2. The mobility bra of claim 1, wherein the front closure is movable between a secured orientation and an unsecured orientation, and wherein in the secured orientation, each of the first lateral adjustment strap and the second lateral adjustment strap extend laterally outward and parallel to the band.

3. The mobility bra of claim 1, wherein the band forms the continuous circuit to define a torso opening, and wherein the torso opening is increasable or decreasable based on proximity of respective distal ends of the first and second lateral adjustment straps to the slider.

4. The mobility bra of claim 1, wherein the slider includes at least one opening through which the first lateral strap and the second lateral strap can be threaded to connect a medial part of the first panel and a medial part of the second panel.

5. The mobility bra of claim 1, wherein the first lateral adjustment strap includes one of a hook or loop area of a hook and loop fastener and the band includes the other of the hook or loop area of the hook and loop fastener, and wherein the first lateral adjustment strap is configured to be secured to the band via the hook and loop fastener.

6. The mobility bra of claim 1, wherein a distal end of the first lateral adjustment strap includes a tapered geometry configured to guide the first lateral adjustment strap through the slider, and a distal end of the second lateral strap includes a tapered geometry configured to guide the second lateral adjustment strap through the slider.

7. The mobility bra of claim 1, wherein the second closure system includes a rear closure system for connecting the band to form the continuous circuit at the rear portion.

8. The mobility bra of claim 7, wherein the rear closure system is permanently closed.

9. The mobility bra of claim 1, further comprising:

a first pull element secured to a distal end of the first lateral adjustment strap and configured to be pulled in a laterally outward direction to tighten the band; and a second pull element secured to a distal end of the second lateral adjustment strap and configured to be pulled in a laterally outward direction, opposite the first pull element, to tighten the band, wherein the first and second pull elements are configured as stops and are dimensioned to prevent a respective distal end of the first and second lateral adjustment straps from passing through the slider.

10. The mobility bra of claim 9, wherein each of the first and second pull elements are configured as removable rings, the removable rings configured to be selectively secured to the respective distal ends of the first and second lateral adjustment straps.

11. The mobility bra of claim 10, wherein the first and second rings are dimensioned to prevent movement of the distal ends of the respective first and second lateral adjustment straps through the slider.

12. A closure system for a bra, the bra having a front portion and a rear portion connected via first and second shoulder straps, the closure system comprising:

a rear closure system configured to connect a band of the bra to form a continuous circuit around a posterior portion of a torso; and a front closure system configured to adjust, disconnect, and connect first and second bra panels and the band of the bra to form a continuous circuit around an anterior portion of the torso, the front closure comprising:

a slider; and at least one lateral adjustment strap extending from a medial end of the front portion of the bra, the at least one lateral adjustment strap dimensioned to extend through the slider in a lateral direction away from the medial end of the front portion and be secured to the band and the at least one lateral adjustment strap configured to adjust the continuous circuit circumferentially.

13. The closure system of claim 12, wherein the rear closure system is configured as a rear strap and is permanently fixed in a closed position.

14. The closure system of claim 12, wherein the at least one lateral adjustment strap is a first lateral adjustment strap and the front closure further comprises a second lateral adjustment strap, and wherein each of the first and second lateral adjustment straps are configured to tighten the band when pulled in opposing directions.

15. The closure system of claim 14, wherein the slider includes a first opening dimensioned to receive the first lateral adjustment strap and a second opening dimensioned to receive the second lateral adjustment strap.

16. The closure system of claim 12, wherein the at least one lateral adjustment strap includes a distal end having a tapered geometry configured to facilitate one-handed operation by guiding the distal end of the at least one lateral adjustment strap through the slider.

17. The closure system of claim 12, further comprising a pull element at a distal end of the at least one lateral adjustment strap configured to be pulled in a lateral direction away from a medial portion of a user to tension the at least one lateral adjustment strap and tighten the band.

18. The closures system of claim 17, wherein the pull element includes an opening dimensioned to receive a digit and is dimensioned to prevent a distal end of the at least one lateral adjustment strap from passing through the slider.

19. A method of adjusting a bra having first and second separable bra panels, the method comprising:

inserting a first arm through a first opening provided by a first shoulder strap;

inserting a second arm through a second opening provided by a second shoulder strap;

pulling on a first lateral strap in a first lateral direction to move the first bra panel in a medial direction and tighten a band of the bra;

pulling on a second lateral strap in a second lateral direction opposite the first lateral direction to move the second bra panel in the medial direction and tighten the band of the bra;

securing the first lateral strap relative to the band; and securing the second lateral strap relative to the band.

20. The method of claim 19, further comprising, before pulling on the first lateral strap and the second lateral strap, closing a rear closure of the bra; and inserting a distal end of the first lateral strap through a slider and inserting a distal end of the second lateral strap through the slider to close a front closure of the bra.

* * * * *